US006102504A

United States Patent [19]

Richardson

[11] Patent Number: 6,102,504

[45] **Date of Patent: *Aug. 15, 2000**

[54] ACCESS TOP COVER FOR WASHING MACHINE

[75] Inventor: Curtis G. Richardson, Herrin, Ill.

[73] Assignee: Maytag Corporation, Newton, Iowa

[ * ] Notice: This patent issued on a continued prosecution application filed under 37 CFR 1.53(d), and is subject to the twenty year patent term provisions of 35 U.S.C. 154(a)(2).

[21] Appl. No.: 09/061,496

[22] Filed: Apr. 16, 1998

[51] Int. Cl.[7] ..... A47B 88/00

[52] U.S. Cl. ..... 312/328; 68/196; 312/290; 312/228

[58] Field of Search ..... 312/228, 327, 312/328, 329, 220, 290; 34/595, 601, 602, 603, 604; 68/3 R, 4

[56] References Cited

U.S. PATENT DOCUMENTS

| | | | |
|---|---|---|---|
| D. 169,113 | 3/1953 | Sundberg . | |
| D. 359,602 | 6/1995 | Swartz et al. . | |
| 2,987,355 | 6/1961 | Sandefur | 312/328 |
| 5,090,785 | 2/1992 | Stamp | 312/290 X |
| 5,102,209 | 4/1992 | Hesseltine | 312/290 |
| 5,253,493 | 10/1993 | Ohashi | 68/4 |
| 5,332,305 | 7/1994 | Slivon et al. | 312/328 |
| 5,515,702 | 5/1996 | Park . | |
| 5,526,657 | 6/1996 | Johnson . | |
| 5,651,188 | 7/1997 | Swanson et al. | 34/82 |
| 5,661,914 | 9/1997 | Millet | 34/601 |
| 5,857,363 | 1/1999 | Jung et al. | 68/196 |

*Primary Examiner*—Janet M. Wilkens
*Assistant Examiner*—Stephen Vu
*Attorney, Agent, or Firm*—Zarley, McKee, Thomte, Voorhees & Sease

[57] ABSTRACT

An improved access top cover for a washing machine includes a top panel having a rear edge, first and second opposite side edges, and a front edge. The upper surface of the top panel includes a sloping surface commencing adjacent the front edge of the top panel and sloping upwardly and rearwardly toward the rear edge of the top panel. An access opening is provided in the top panel and a lip flange is positioned between the access opening and the front edge of the top panel. The lip flange forms a ridge which is located above both of the front edge of the top panel and the access opening.

18 Claims, 3 Drawing Sheets

ACCESS TOP COVER FOR WASHING MACHINE

BACKGROUND OF THE INVENTION

This invention relates to an improved access top cover for a washing machine.

There is a need for easier and improved access to the interior of top loading washing machines. One method of improving this access is the provision of a top cover for the washing machine which includes a horizontal surface at the rear of the top cover and a sloping surface at the front of the top cover. An example of this design is shown in Design Patent 359,602. This design lowers the front edge of the access opening so as to provide easier access to the interior of the machine from the front of the washing machine.

One problem encountered when lowering the front edge of the access opening for the washing machine is the need for preventing water from splashing outwardly from the front edge of the access opening. There is a need to redirect any such splashed water back inwardly towards the interior of the washing machine so as to prevent water drainage outwardly along the front surface of the washing machine.

Therefore a primary object of the present invention is the provision of an improved access top cover for washing machines.

A further object of the present invention is the provision of an improved access top cover having a lip flange located adjacent the front edge of the easy access opening for directing fluid inwardly toward the center of the access opening and for preventing fluid from draining forwardly towards the front edge of the top cover.

A further object of the present invention is the provision of an improved access top cover which is economical to manufacturer, durable in use, and attractive in appearance.

SUMMARY OF THE INVENTION

The foregoing objects may be achieved by an improved access top cover comprising a top panel having a rear edge, first and second opposite side edges and a front edge. The top panel includes an upper surface having a sloping surface commencing adjacent the front edge of the top panel and sloping upwardly and rearwardly toward the rear edge of the top panel. An access opening is provided in the top panel, and a lip flange is positioned between the access opening and the front edge of the top panel. The lip flange forms a ridge which is located above both of the front edge of the top panel and above the access opening.

The lip flange forms a barrier or dam which directs water inwardly toward the access opening whenever water is splashed towards the front of the top cover.

DETAILED DESCRIPTION OF THE PREFERRED EMBODIMENT

Figure 1:
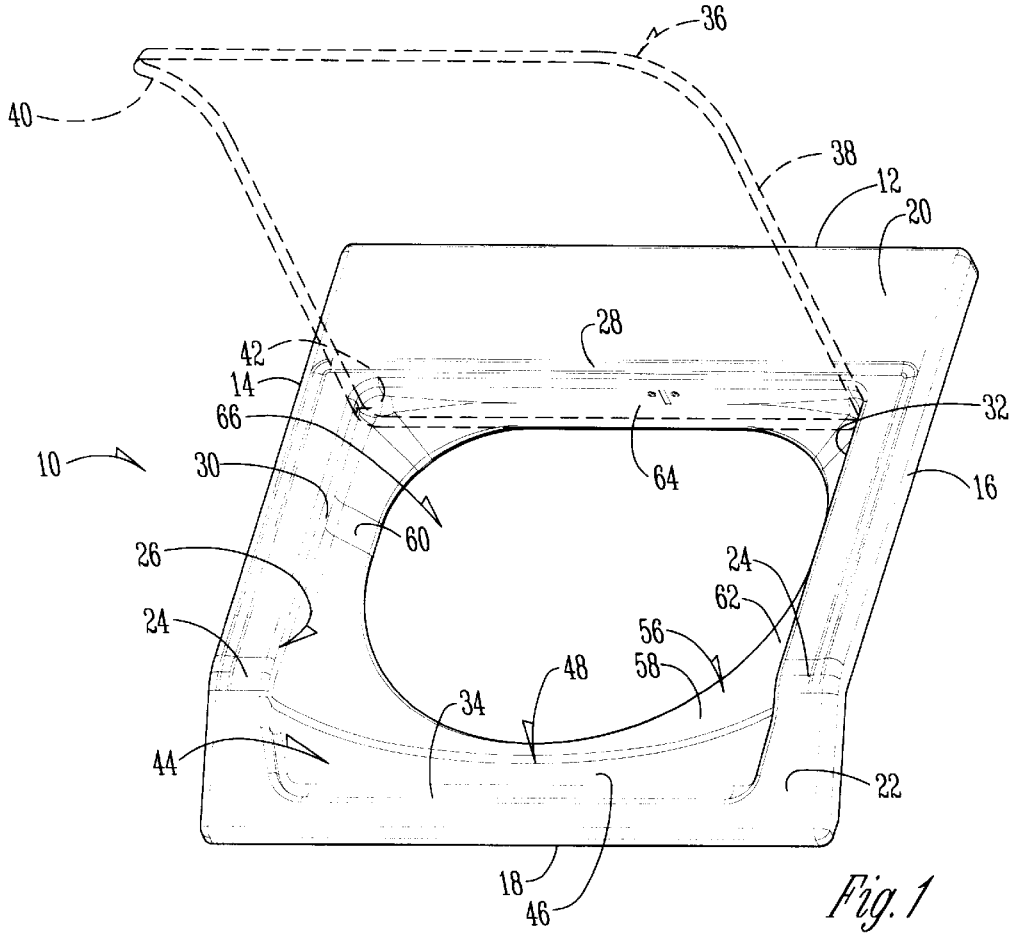
FIG. 1 is a perspective view of the top cover of the present invention showing a door for the top cover in shadow lines.

Referring to the drawings the numeral 10 generally designates the top cover of the present invention. Top cover 10 is adapted to be mounted upon a washing machine 11 shown partially in FIG. 2. the washing machine 11 includes a cabinet with a front wall 11A, opposite side walls 11B, and a rear wall 11C.

Top cover 10 includes a rear edge 12, side edges 14, 16, and a front edge 18. The upper surface of the top cover 10 includes a horizontal surface 20 which is located rearwardly of a front sloping surface 22. The juncture between the front sloping surface 22 and the rear horizontal surface 20 is designated by the numeral 24.

The upper surface of the top cover 10 also includes a door recess or depression 26 having a rear edge 28, side edges 30, 32, and a front edge 34. The door recess 26 is positioned so that it extends partially into the horizontal surface 20 and partially into the front sloping surface 22 of the top cover 10. FIG. 1 shows a door 36 in shadow lines which includes a horizontal portion 38 and a sloped portion 40 shaped to conform to the shape of the door recess 26. Door 36 is hinged about a hinge access 42 in conventional fashion.

Figure 2:
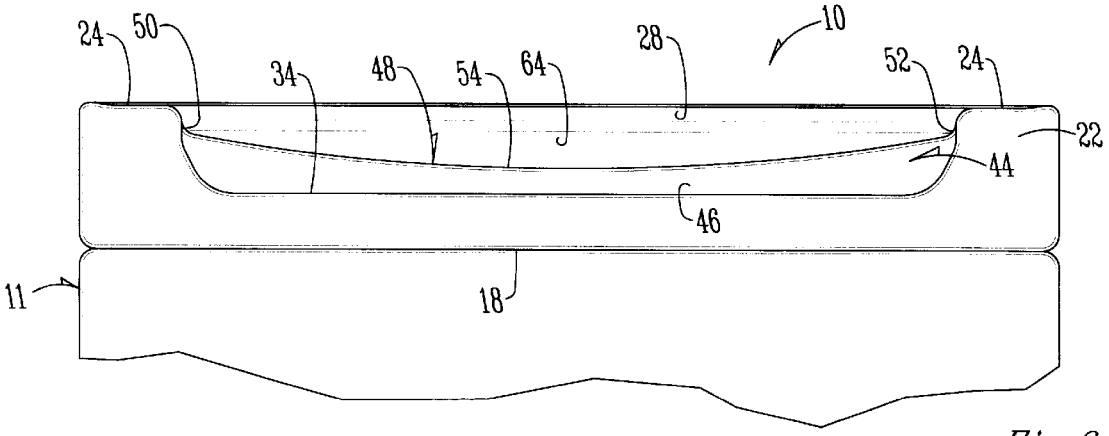
FIG. 2 is a front elevational view showing the top cover of FIG. 1 mounted on the top of a washing machine.
Figure 3:
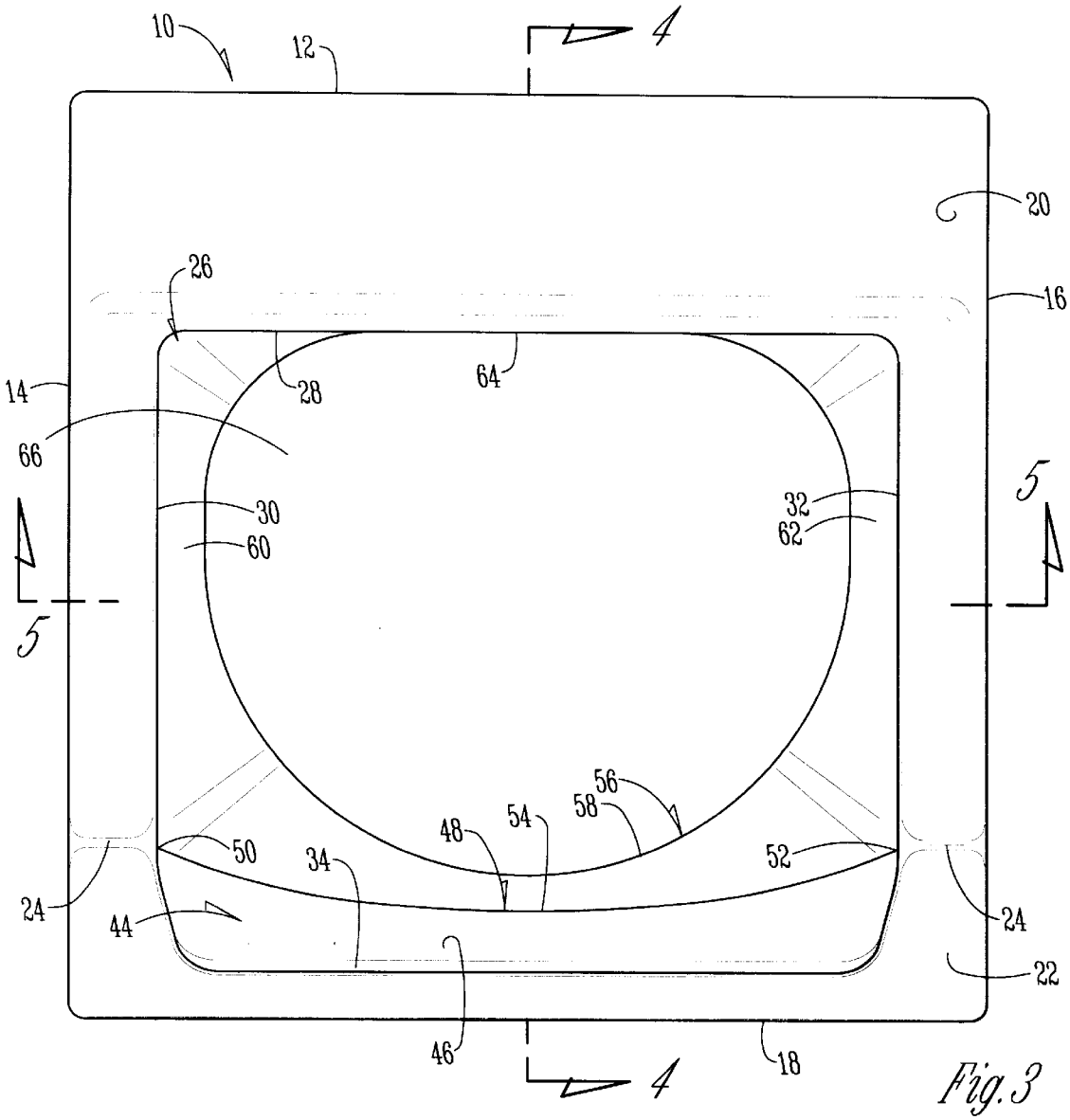
FIG. 3 is a top plan view of the top cover of the present invention.
Figure 6:
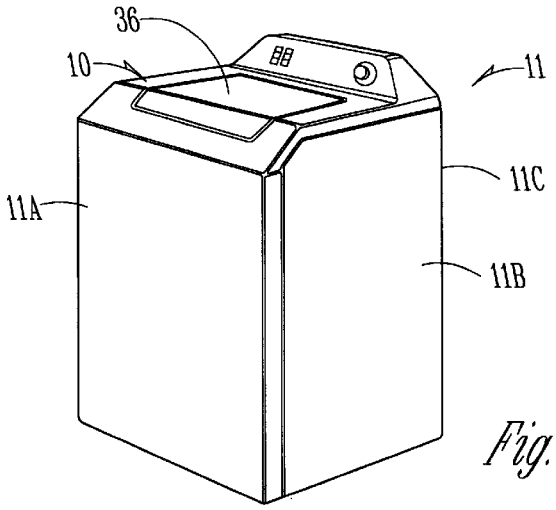
FIG. 6 is a perspective view showing the top loading washing machine with the access top cover of the present invention.
Figure 4:
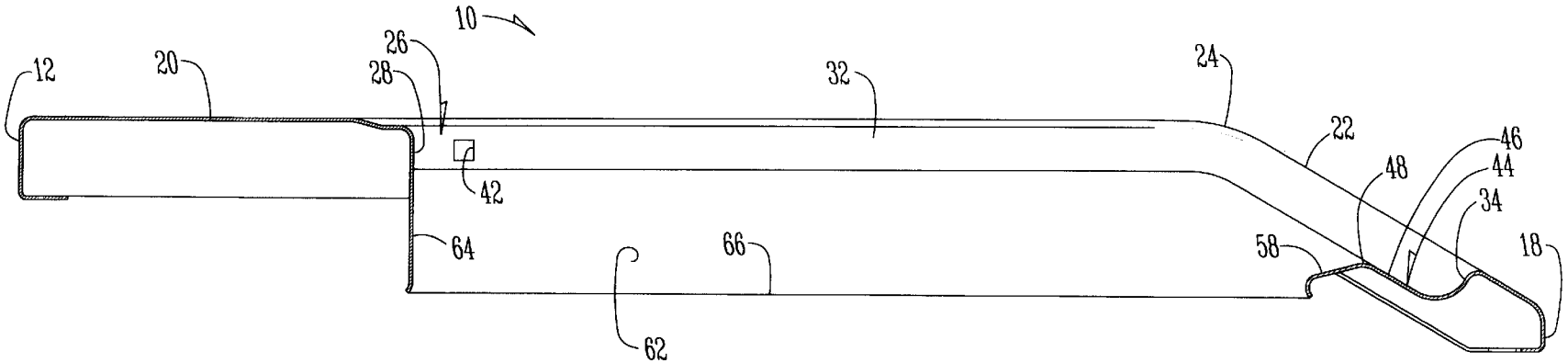
FIG. 4 is a sectional view taken along line 4—4 of FIG. 3.
Figure 5:
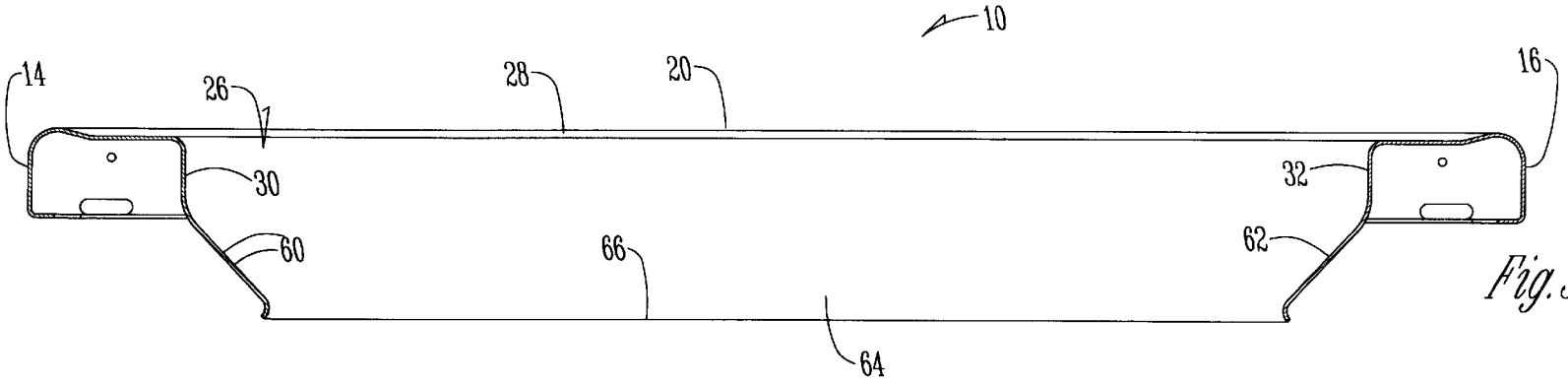
FIG. 5 is a sectional view taken along line 5—5 of FIG. 3.

Extending upwardly from the front edge 34 of door recess 26 is a lip flange 44 having a lower front edge 46. Lip flange 44 extends upwardly and rearwardly from front edge 46, 34 to terminate in a ridge 48. Ridge 48 extends in a line having opposite ends 50, 52, and having an intermediate portion 54. As can be seen in FIGS. 2, and 4, the intermediate portion 54 of the ridge 48 is positioned below the opposite ends 50, 52. As can be seen in FIG. 3, the intermediate portion 54 is also located forwardly from the opposite ends 50, 52. By positioning the ridge 48 substantially lower than the side edges 14 and 16 of the horizontal surface 20, by lowering the ridge 48 at the intermediate portion 54, and by extending the intermediate portion 54 forwardly, an improved and easier access is obtained to the interior of the washing machine 11.

Extending downwardly from the ridge 48 of lip flange 44 is a tapered drain surface or skirt 56 comprising a front drain surface 58 which extends downwardly from the ridge 48, opposite side drain surfaces 60, 62 which extend downwardly and inwardly from the side edges 30, 32 of door recess 26, and a rear drain surface 64 which extends downwardly from the rear edge 28 of door recess 26. The lower edges of the tapered drain surface 56 form an access opening 66 into the interior of the washing machine 11.

The position of the ridge 48 of lip flange 44 relative to the access opening 66 is important. As can be seen in FIG. 4, the ridge 48 of lip flange 44 is positioned between and above access opening 66 and front edge 18 of the top cover 10. Thus the ridge 48 forms a dam or barrier between access opening 66 and front edge 18 to prevent water from splashing or draining outwardly toward the front edge 18 from the interior of the washing machine 11. Any such water which splashes upwardly encounters the ridge 48 and is directed back inwardly to the access opening 66 by means of the ridge 48 and the front drain surface 58. In addition, the positioning of the ridge 48 substantially below the horizontal surface 20 provides improved operator access to the interior or the washing machine 11.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. An improved access top loading washing machine, having a front wall, opposite side walls, and a rear wall, the improvement comprising:

a top panel comprising a rear edge, first and second opposite side edges adjacent the side walls, and a front edge adjacent the front wall;

said top panel having a horizontal upper surface and a sloping surface commencing adjacent said front edge of said top panel and sloping upwardly and rearwardly toward said upper surface of said top panel;

an access opening in said top panel;

a lip flange positioned between said access opening and said front edge of said top panel;

said lip flange forming a raised ridge located above both of said front edge of said top panel and said access opening, wherein said ridge of said lip flange extends along a line having a first end, a second end, and an intermediate portion said intermediate portion, being below said first and second ends; and said intermediate portion of said line is positioned closer to said front edge of said top panel than said first and second ends of said line.

2. The improved top loading washing machine according to claim 1 wherein said lip flange includes a drainage surface commencing at said ridge of said lip flange and extending downwardly and rearwardly toward said access opening.

3. The improved top loading washing machine according to claim 2 wherein said access opening includes a rear margin, opposite side margins, and a front margin, said drainage surface of said lip flange extending to and forming said front margin of said access opening.

4. The improved top loading washing machine according to claim 3 wherein said drainage surface further extends around and forms said rear, opposite side, and front margins of said access opening.

5. The improved top loading washing machine according to claim 1 wherein said upper surface of said top panel further comprises an approximately horizontal surface positioned between said sloping surface and said rear edge of said top panel.

6. The improved top loading washing machine according to claim 5 wherein said access opening is formed partially in said approximately horizontal surface and partially in said sloping surface of said top panel.

7. The improved top loading washing machine according to claim 5 wherein said upper surface of said top panel further comprises a door recess therein having an outer perimeter shaped in a predetermined configuration corresponding to the shape and configuration of an access door, said door recess being partially in said horizontal surface of said top panel and being partially in said sloping surface of said top panel.

8. The improved top loading washing machine according to claim 1 wherein said lip flange further comprises a front surface which extends from said ridge of said lip flange downwardly and forwardly toward said front edge of said top panel.

9. The improved top loading washing machine according to claim 1 wherein said upper surface of said top panel further comprises a door recess therein having an outer perimeter shaped in a predetermined configuration corresponding to the shape and configuration of an access door.

10. An improved access top loading washing machine, having a cabinet with vertical front, back and side walls, the improvement comprising:

a top panel on top of the front and side walls of the cabinet, and including a rear edge, first and second opposite side edges, and a front edge;

said top panel having an upwardly presented surface which includes a sloping surface commencing adjacent said front edge of said top panel and sloping upwardly and rearwardly;

an access opening in said top panel;

said top panel including a lip flange having a tapered drainage surface extending downwardly from said upwardly presented surface of said top panel and terminating at said access opening;

said lip flange having a raised ridge portion positioned between and above said access opening and said front edge of said top panel wherein said ridge portion of said lip flange is positioned below said rear edge of said top panel; and said access opening is located between said ridge portion and said rear edge of said top panel.

11. The improved top loading washing machine according to claim 10 wherein said ridge portion extends in a curved line having opposite ends and an intermediate portion, said intermediate portion being positioned below said opposite ends.

12. The improved top loading washing machine according to claim 10 wherein said upwardly presented surface of said top panel further comprises an approximately horizontal surface positioned between said sloping surface and said rear edge of said top panel.

13. The improved top loading washing machine according to claim 12 wherein said approximately horizontal surface is above said ridge portion of said lip flange.

14. The improved top loading washing machine according to claim 13 wherein said upwardly presented surface of said top panel further comprises a door recess having an outer perimeter surrounding said drain surface and being shaped to matingly receive a door panel having a predetermined shape.

15. The improved top loading washing machine according to claim 14 wherein said door recess is partially in said approximately horizontal surface of said top panel and is partially in said sloping surface of said top panel.

16. A top loading washing machine, comprising:

a top panel having a rear edge, opposite side edges, and a front edge;

the top panel including a horizontal surface and a downwardly sloping forward surface;

a lip flange in the top panel having downwardly extending surfaces terminating in an access opening;

a raised ridge in the lip flange extending above the front edge of the top panel, wherein the ridge has a central portion and opposite end portions, and extends laterally across the lip flange adjacent the sloped forward surface of the top panel;

the ridge further has a height which is less at the central portion than at the opposite end portions; and the ridge is curved so as to be closer to the front edge of the top panel at the central portion than at the opposite end portions.

17. The machine of claim 16 wherein the access opening has a perimeter with a first portion positioned under the horizontal surface of the top panel and a second portion positioned under the sloping forward surface of the top panel.

18. The machine of claim 16 further including a door pivotally mounted on the top panel for movement between open and closed positions relative to the access opening.

* * * * *